United States Patent [19]

Thoenen

[11] Patent Number: 4,609,186

[45] Date of Patent: Sep. 2, 1986

[54] MATTRESS SPRING CORE WITH OPEN ENDED COILS

[75] Inventor: Alan Thoenen, St. Gallen, Switzerland

[73] Assignee: Spuhl AG, St. Gallen, Switzerland

[21] Appl. No.: 798,142

[22] Filed: Nov. 14, 1985

Related U.S. Application Data

[63] Continuation of Ser. No. 507,361, Jun. 24, 1983, abandoned.

[30] Foreign Application Priority Data

Jun. 28, 1982 [CH] Switzerland ..... 3957/82

[51] Int. Cl.[4] ..... F16F 3/04

[52] U.S. Cl. ..... 267/91; 267/103; 5/248; 5/256; 5/269; 5/271

[58] Field of Search ..... 267/61 R, 91, 101, 103, 267/166, 167, 180; 5/248, 254, 256, 257, 269, 271–274, 475

[56] References Cited

U.S. PATENT DOCUMENTS

| | | | |
|---|---|---|---|
| 664,756 | 12/1900 | Hunt | 5/256 |
| 1,108,316 | 8/1914 | Baker | 5/256 X |
| 1,344,636 | 6/1920 | Jackson . | |
| 1,546,273 | 8/1926 | Karr | 267/91 X |
| 1,798,885 | 3/1931 | Karr | 5/256 X |
| 1,887,058 | 11/1932 | Karr | 5/256 X |
| 2,010,986 | 8/1935 | Goethel | 5/256 X |
| 2,374,850 | 5/1945 | Wunderlich | 5/256 X |
| 2,581,686 | 1/1952 | McRoskey | 5/256 X |
| 2,631,840 | 3/1953 | Bugenhagen | 267/180 |

FOREIGN PATENT DOCUMENTS

| | | | |
|---|---|---|---|
| 244416 | 7/1979 | Spain . | |
| 2221263 | 5/1942 | Switzerland . | |
| 0386251 | 1/1933 | United Kingdom | 267/91 |
| 807194 | 1/1959 | United Kingdom . | |
| 1376281 | 12/1974 | United Kingdom . | |

*Primary Examiner*—Bruce H. Stoner, Jr.
*Assistant Examiner*—Michael P. Gilday
*Attorney, Agent, or Firm*—Sughrue, Mion, Zinn, Macpeak and Seas

[57] ABSTRACT

A spring core comprises a plurality of coil springs 10 each made of a single, continuous piece of wire having two open ended final windings 11 which are approximately U-shaped. The coil springs are held together by spiral shaped connecting elements 30 enclosing the straight lateral arms 12, 13 of the final windings.

1 Claim, 3 Drawing Figures

MATTRESS SPRING CORE WITH OPEN ENDED COILS

This is a continuation of application Ser. No. 507,361 filed June 24, 1983, now abandoned.

BACKGROUND OF THE INVENTION

This invention concerns a spring core for a mattress in which the individual spring coils have open ended final turns.

Known springs of the Bonnell or offset type have circular or partially bulging final windings closed by a knot. These springs are produced automatically and assembled to form a comfortable elastic spring core. The assembly of individual springs results in inherently stable and uniform spring cores which can be produced in different configurations without comprehensive adjustments in the production process. Mattresses can be produced which are optimally adjusted to individual requirements by modifications in the density, the number of springs, the final ring diameter and the number of windings.

These spring cores have the disadvantage that the closing knots are undesirably constrictive, and friction resistant intermediate layers must be installed in the mattresses to avoid chafing through the upholstery and to prevent the projecting knots from being felt when lying on the mattress. Further, since with Bonnell and offset springs only 40 to 60% of the wire really provides active elasticity, the material consumption is comparatively high which is economically important in the production of spring cores with modern machinery, where the share of the material cost reaches more than 90% of the total production cost.

Spring cores with knotless coil springs are known, for example, from Canadian Pat. No. 1,080,452 and German Pat. No. 2,003,082, wherein several or all of the coil springs are made from a single, continuous piece of wire. The production of such complex wire structures requires expensive shaping tools which are very difficult to adjust. The spring configurations thus cannot be easily modified with regard to, for example, the height of the springs, the distances between the springs, and the diameter of the springs. Furthermore, any thermal treatment is difficult during the production process.

SUMMARY OF THE INVENTION

It is an object of this invention to provide a spring core of the type mentioned above which avoids the prior art disadvantages, but which has at least a comparable elastic comfort and can be produced at low cost and essentially automatically. This object is achieved by providing spring coils each having straight sided, U-shaped open final turns facing opposite directions, and by assembling the coils in a core array with the final turns of adjacent rows being oppositely oriented.

The spring core thus formed has the additional advantages that the wire requirement is essentially lower per given mattress dimension than in the prior art, while the "active" wire portion or area per spring is higher.

DETAILED DESCRIPTION OF THE PREFERRED EMBODIMENT

Figure 1:
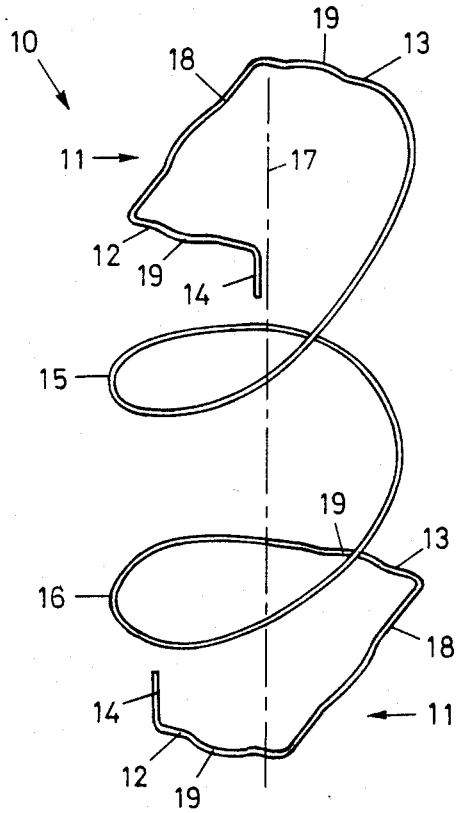
FIG. 1 shows a perspective view of an individual coil spring according to the invention.

As shown in FIG. 1, a coil spring 10 consists of a single continuous piece of wire which has two final turns or windings 11 and two intermediate coil windings 15 and 16, the final windings being disposed in parallel planes which are perpendicular to the spring axis 17. The open final windings 11 are generally U-shaped with two shorter lateral arms 12 and 13 running tangent to the coil windings and a central arm 18 disposed as a secant. Each outer arm 12 ends in a short length of wire 14 which runs essentially parallel to the spring axis 17, although it could also be turned in parallel to the central arm 18.

Figure 2:
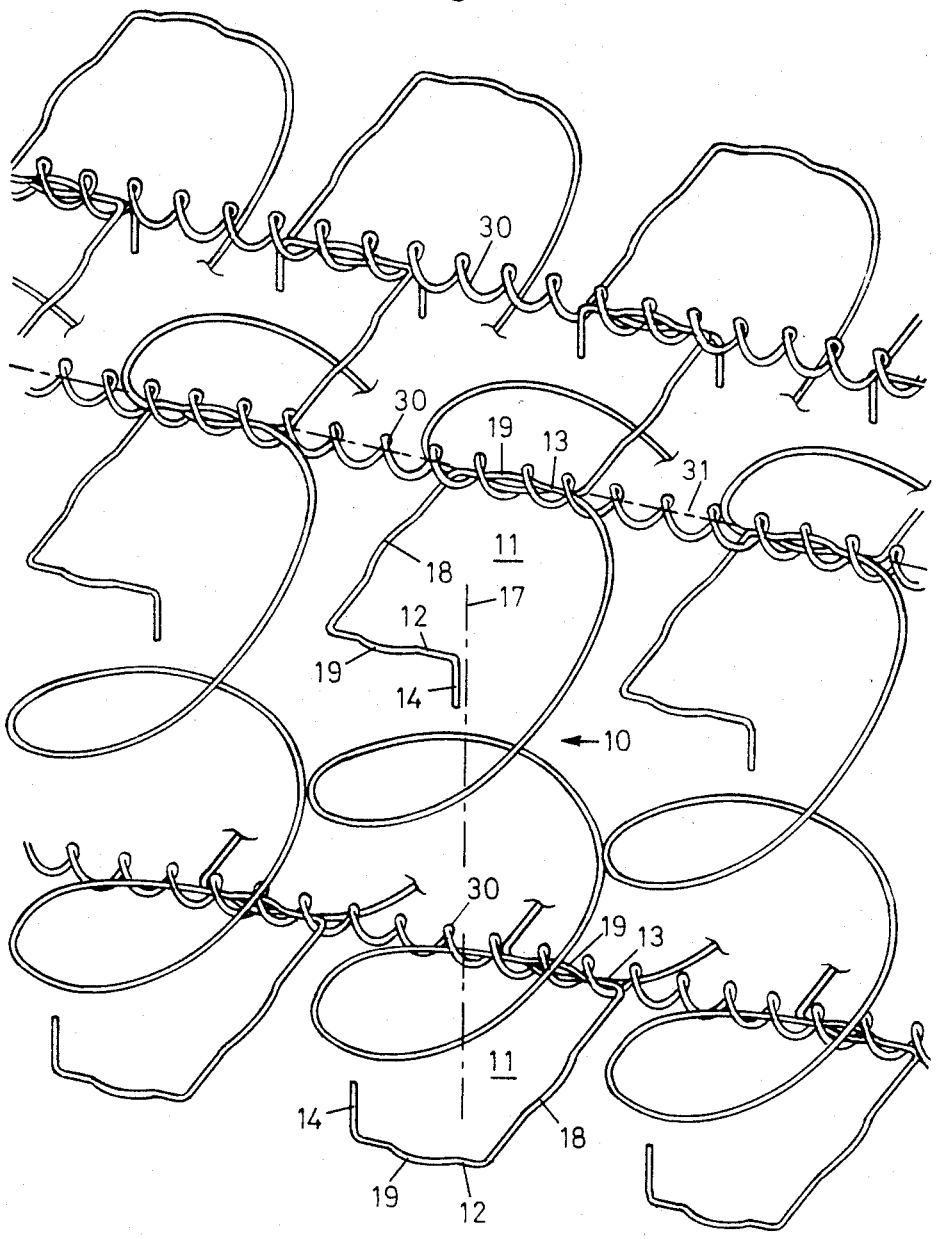
FIG. 2 shows a perspective view of a portion of a spring core assembled from the coil springs of FIG. 1.

FIG. 2 shows a portion of a spring core which consists of several coil springs 10 joined with each other by spiral shaped connecting elements 30. All of the springs in a given row running parallel to the connecting elements are equally aligned, while the springs of the two adjacent or flanking rows are each turned 180° to the spring axis 17 such that the enclosed lateral arms and central arms of the final windings define zig-zag patterns over upper and lower surfaces of the core to establish uniform surface densities. Lateral evasion of the spring core under load is prevented by this alternating spring arrangement, which renders the stiffening effect of closing knots unnecessary. The connecting elements 30 always combine two outer or two inner lateral arms 12 or 13 of the final windings 11 of adjacent coil springs. The central arms 18 and the wire ends 14 are always perpendicular to the axis 31 of the connecting elements, which prevents any lateral shifting of the coil springs. Since adjacent springs are connected with each other along the essentially straight lateral arms 12 and 13, good support of the coil springs is achieved in the connecting spiral as well as a hinge effect, which results in an optimum adjustment of the spring core to the body shape of a person lying on it.

Figure 3:
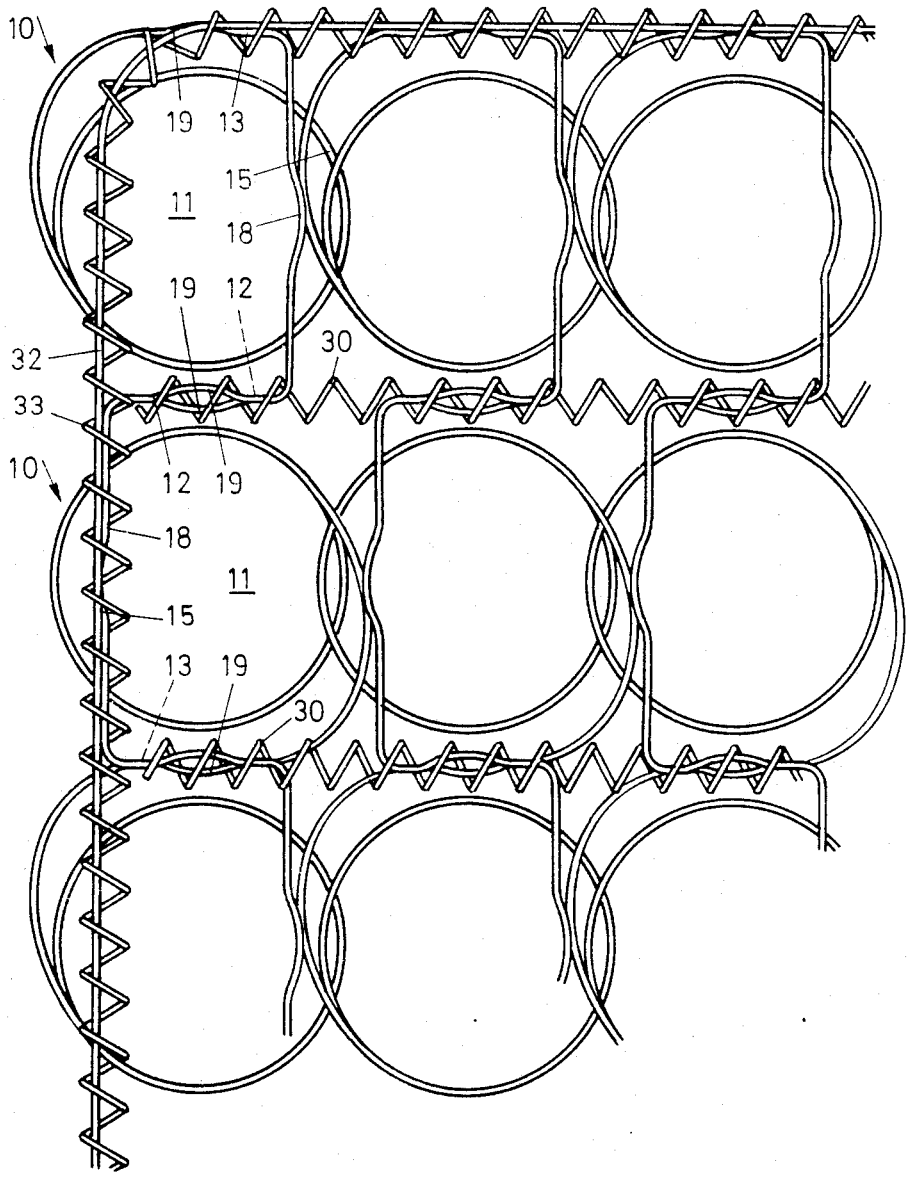
FIG. 3 shows a top view of a corner portion of an assembled spring core.

FIG. 3 shows a top view of a corner portion of a spring core, and clearly illustrates the alternating arrangement of the final turns 11 disposed in the same plane. The springs at the edge of the core are connected by an encircling frame wire 32, and the lateral and central arms are connected with the wire 32 by a spiral 33 which provides a stable stiffening at the edge of the core. The guiding and retention of the coil springs 10 in the connecting elements 30 and spiral 33 is improved by the curved bulges 19 in the lateral and central arms of the final windings.

What is claimed is:

1. A spring core for a mattress, comprising: a plurality of identically configured helical circular coil springs (10) each made of a single, uninterrupted piece of wire having upper and lower final windings disposed in planes perpendicular to a spring axis, said springs being connected with each other at their final windings (11) by spiral shaped connecting elements (30) lying in said planes, each coil spring having open ended final windings which are approximately U-shaped, and the connecting elements fully enclosing straight lateral arms (12, 13) of the final windings, wherein the lateral arms of each final winding form a sharp right angle with an intermediate straight central arm (18), the central arm of each final winding overlies the helical circular coils (15, 16) of the associated spring in the manner of a secant, the lateral arms are substantially shorter than the central arms and lie radially outside of the helical circular coils, each lateral and central arm has a single outwardly directed bow-shaped bulge (19), a short length of end wire (14) at an outer lateral arm (12) of each final winding is bent at an approximate right angle to the outer lateral arm and runs parallel to the spring axis (17), all of the coil springs in a row running parallel to the connecting elements are equally aligned, and the coil springs of adjacent flanking rows are rotated 180° relative to the spring axes such that the enclosed lateral arms and central arms of the final windings define zigzag patterns over upper and lower surfaces of the core to establish uniform surface densities.

* * * * *